US005319838A

United States Patent [19]

Eppenauer

[11] Patent Number: 5,319,838

[45] Date of Patent: Jun. 14, 1994

[54] EYEGLASS HOLDER

[76] Inventor: Rachel I. Eppenauer, 155 W. Sunset, San Antonio, Tex. 78209

[21] Appl. No.: 730,534

[22] Filed: Jul. 16, 1991

[51] Int. Cl.[5] ..... A44B 21/00

[52] U.S. Cl. ..... 24/3C; 24/13

[58] Field of Search ..... 24/3 R, 3 C, 3 E, 3 L, 24/3 F, 13; 206/5; 351/155, 157, 112

[56] References Cited

U.S. PATENT DOCUMENTS

| | | | |
|---|---|---|---|
| 1,170,859 | 2/1916 | Walker | 24/3 E |
| 2,818,621 | 1/1958 | Pretz | 24/13 |
| 3,148,812 | 9/1964 | Hilsinger . | |
| 4,452,354 | 6/1984 | Tabachnick . | |
| 4,458,384 | 7/1984 | Arnold . | |
| 4,771,515 | 9/1988 | Guarro . | |
| 4,894,887 | 1/1990 | Ward, II . | |
| 5,033,612 | 7/1991 | Bivins | 206/5 |

*Primary Examiner*—James R. Brittain
*Attorney, Agent, or Firm*—Donald R. Comuzzi; Christopher L. Makay

[57] ABSTRACT

An eyeglass holder of ornamental design is constructed such that it may be worn with any garment in any position. The holder is a continuous loop shaped to form a first and second portion defining an opening therebetween, wherein a temple sidepiece of a pair of eyeglasses is placed through the opening and supported in a pendulous nature such that the eyeglasses maintain a substantially downward orientation regardless of eyeglass holder position. Additionally, the eyeglass holder is provided with a third portion from which objects such as an identification badge may be suspended.

4 Claims, 2 Drawing Sheets

EYEGLASS HOLDER

BACKGROUND OF THE INVENTION

1. Field of the Invention

The present invention relates to a holder for eyeglasses and more particularly to an inconspicuous eyeglass holder which is adapted to be pinned on any garment of an eyeglass wearer for pendulously supporting a pair of eyeglass.

2. Description of the Prior Art

Eyeglasses, when not worn, are often carried in a bulk case or a pouch for protection and may be placed in a pocket or handbag. However, when glasses are frequently put on and taken off, it is desirable to have them in a more easily and quickly accessible position. Thus, glasses may be hung in front of the user by an elastic cord encircling the neck and attached to the end portions of each temple piece. That arrangement is somewhat unsatisfactory because the eyeglasses remain open and rest against the chest of the wearer, and with an especially active person, the eyeglasses may swing about excessively and be damaged as well as interfere with or restrict a person's movement. More frequently, people tend to merely fold up their eyeglasses and slip them in a shirt or coat pocket where they may be scratched by other material carried in the pockets or fall out causing possible damage.

Accordingly, eyeglass holders which support the eyeglasses in a safe, accessible, and compact manner have been developed. One such eyeglass holder is U.S. Pat. No. 4,458,384 issued to Arnold. The Arnold patent discloses a wire segment in a double loop configuration which may be pinned to the clothing of an eyeglass wearer. An eyeglass wearer then slides one of the temple sidepieces through both loops to secure the eyeglasses. However, this design presents the same problem as encountered when eyeglasses are left lose in a pocket. That is, when the eyeglass wearer bends over, the eyeglasses have a tendency to fall out causing breakage.

Therefore, a second design which attempts to solve that problem has been disclosed in U.S. Pat. No. 4,894,887, issued to Ward, II. The Ward, II patent discloses a pair of interconnected, downward extending fingers used as a clip-on connection to a shirt, coat pocket, or belt formed with an integral loop so that a temple sidepiece of a pair of eyeglasses may be suspended from the loop. Although the single loop design purports to solve the above problem because the pendulous nature of the eyeglass support allows the glasses to assume a substantially downward inclination even though the user bends over, thereby, keeping the eyeglasses from falling out, there still are several design limitations. For example, the clip design for use with only a pocket or belt limits the position and type of clothing where the eyeglass retainer may be used. A dress having no pockets or belt would be a type of clothing incompatible with the clip-on eyeglass retainer. In addition, the front clip portion attached to the loop extends below the loop and can restrict the swing of the glasses as well as cause difficulty when the eyeglasses are placed in or removed from the loop, thereby, reducing accessibility. Thus, the design of the eyeglass holder of the present invention has been advanced to overcome many of the above problems.

SUMMARY OF THE INVENTION

The present invention is a continuous loop which is substantially oval in shape bent about its middle such that it forms first and second portions substantially perpendicular to each other. That design presents the improvement of a large and unobstructed opening being formed between the first and second portions through which a temple sidepiece of eyeglasses of almost any size may be placed. That large opening allows for easy and quick access to the glasses while still providing the support necessary to ensure that the glasses do not fall out causing potential breakage. The single loop design also allows eyeglass support of a pendulous nature such that the eyeglasses in the eyeglass holder will always maintain a substantially downward inclination regardless of the orientation of the holder. In addition, the smooth rounded front of the second portion allows the glasses to easily shift from side to side with the user's body movements. Furthermore, the eyeglass holder of the present invention is provided with a pin and clasp so that it can be conveniently attached to any garment, including a dress that has no pockets or belt.

Therefore, it is an object of the present invention to provide a small, ornamental eyeglass holder to provide eyeglass support regardless of user body orientation and that further may be attached to any piece of clothing in almost any position.

Additionally, it is an object of the present invention to provide the eyeglass holder with a third portion to which objects such as identification badges may be suspended.

It is a further object of the present invention to provide the eyeglass holder of the present invention with a loop attached to the first portion so that the eyeglass holder may be suspended about the neck of an eyeglass wearer using a chain.

The above and further features of the invention will be better understood with respect to the following detailed description of a preferred embodiment considered in combination with the several figures of the accompanying drawings.

DETAILED DESCRIPTION OF THE PREFERRED EMBODIMENT

Figure 1:
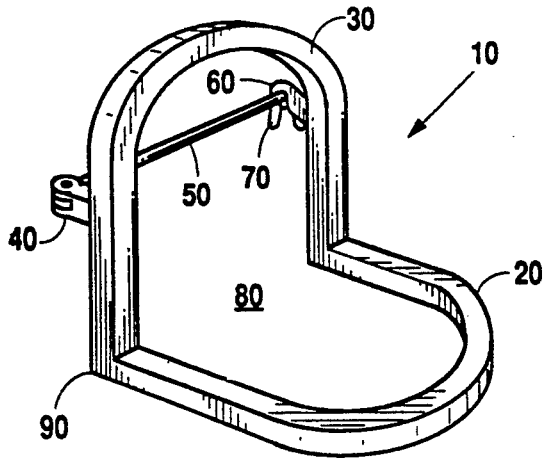
FIG. 1 is a perspective view of the eyeglass holder of the present invention.
Figure 2:
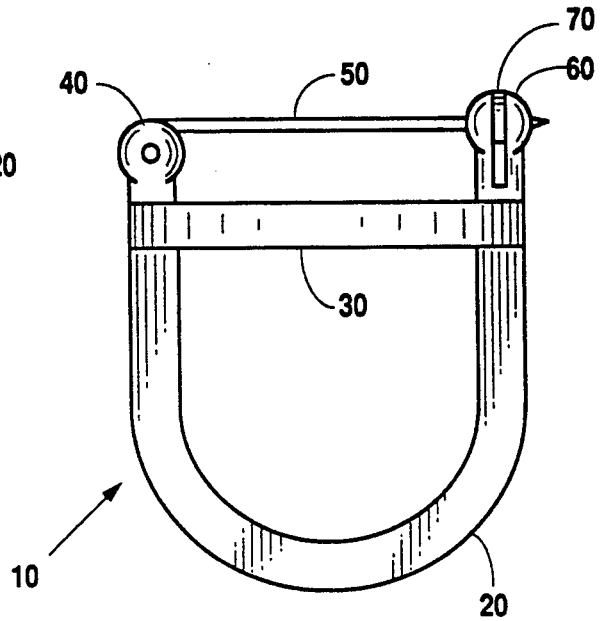
FIG. 2 is a top view of the eyeglass holder of the present invention.
Figure 3:
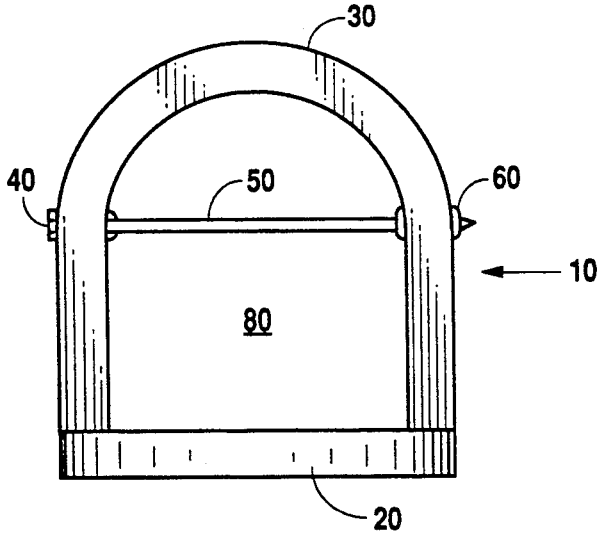
FIG. 3 is a front view of the eyeglass holder of the present invention.
Figure 4:
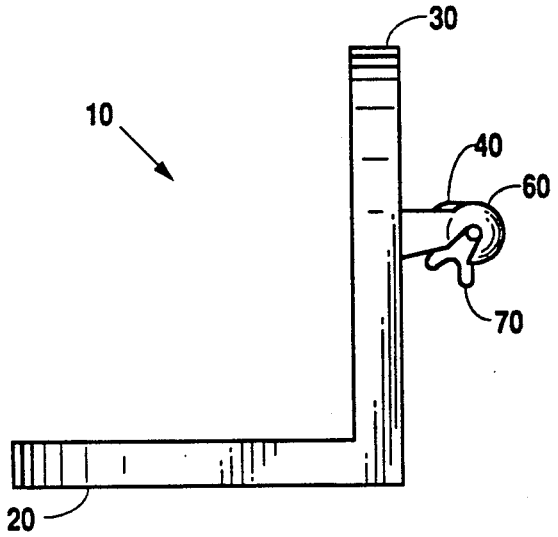
FIG. 4 is a right side view of the eyeglass holder of the present invention.

Referring to FIGS. 1–4, eyeglass holder 10 of the present invention will be described. Eyeglass holder 10 is constructed of a precious metal such as gold or silver or other substantially rigid material formed into continuous loop 90 which is substantially oval in shape and bent about its middle to form a first portion 30 and a second portion 20. First portion 30 and second or lower portion 20 are positioned substantially perpendicular to each other creating opening 80 formed therebetween. For the purposes of disclosure, upper member 30 and lower member 20 were described as being substantially perpendicular, however, one of ordinary skill in the art will understand that any angle which will still allow eyeglass support could be used.

The back portion of first portion 30 is further formed with joint 40 to which pin 50 is pivotally connected. The opposite end of pin 50, after it has passed through the clothing to which eyeglass holder 10 is to be attached, fits into clasp 60 and held in place when clip 70 of clasp 60 is rotated into the position shown in FIG. 4. Although the preferred embodiment discloses the pin and clasp means as shown in FIGS. 1–4, 6 and 8, one of ordinary skill in the art will understand that any pin and clasp could be used. For example, the straight pin with removable clasp used in military decorations could easily be employed.

Although the preferred embodiment discloses the use of precious metals because of the ornamental nature of the present invention, one of ordinary skill in the art will readily recognize that any non-precious metal such as copper or brass or wood or any synthetic material such as a plastic may be used, and further that the loop structure could be substituted for by any other shape or ornamental design.

After eyeglass holder 10 has been pinned to the desired garment, one temple sidepiece of a pair of folded glasses is inserted inside of lower member 20 through opening 80. Thus, the eyeglasses are held firmly while still allowing the eyeglasses to swing freely as the eyeglass holder user bends over. Additionally, the size of opening 80 is such that the eyeglasses are easily and quickly accessible, yet still solves the problem of the eyeglasses falling out and possibly breaking.

The preferred method of making eyeglass holder 10 is from a one piece molded construction. However, one of ordinary skill in the art could use any means to fashion eyeglass holder 10.

Figure 5:
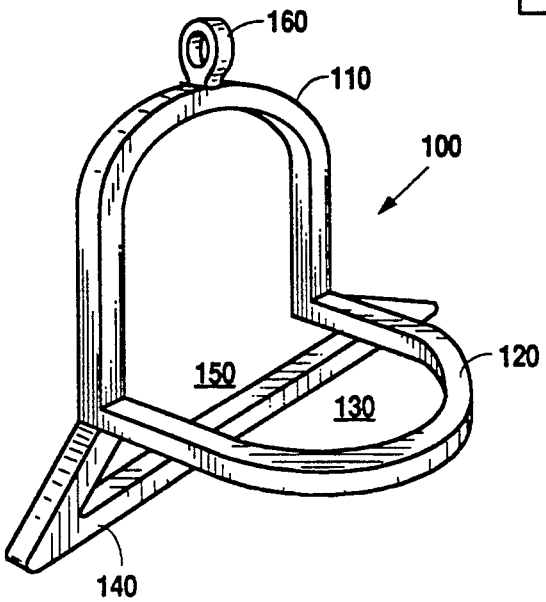
FIG. 5 is a perspective view of an alternative embodiment of the present invention showing an eyeglass holder capable of being suspended about the neck and further having a badge holder.
Figure 6:
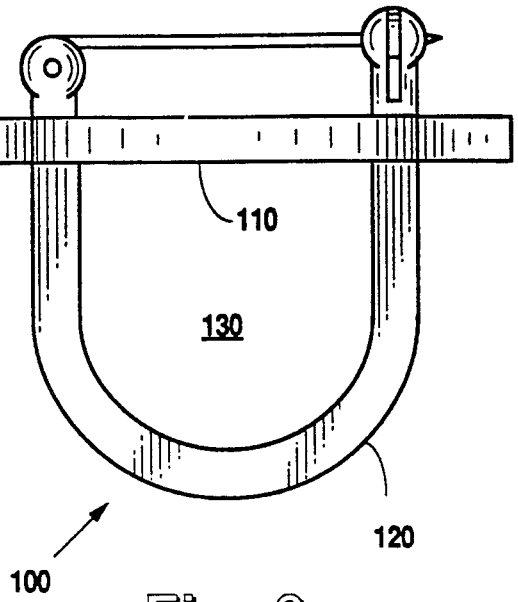
FIG. 6 is a top view of the alternative embodiment of the present invention showing the badge holder with a pin and clasp.
Figure 7:
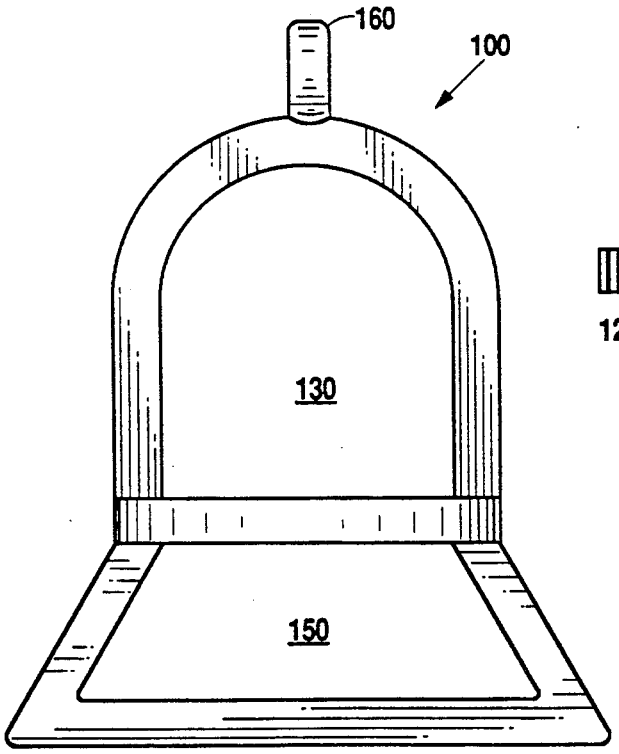
FIG. 7 is a front view of the alternative embodiment of the present invention showing the eyeglass holder capable of being suspended about the neck and further having a badge holder.
Figure 8:
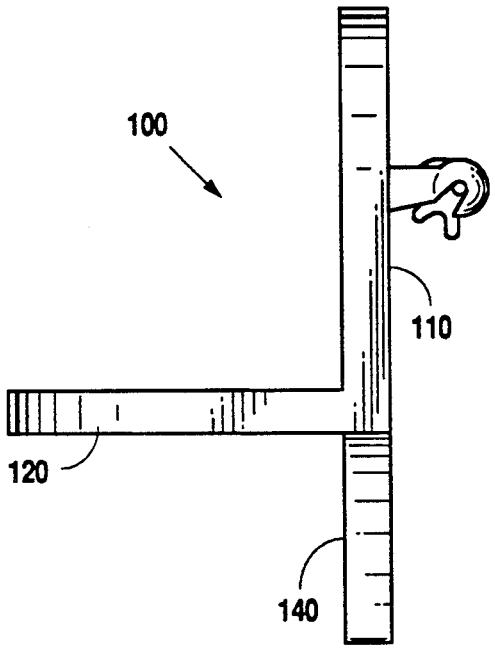
FIG. 8 is a side view of the alternative embodiment of the present invention having a pin and clasp.

Referring to FIGS. 5–8, the alternative embodiment of the present invention will be disclosed. Eyeglass holder 100 is constructed of the same materials and in the same manner as described above. Furthermore, first portion 110 and second portion 120 form opening 130 therebetween through which a sidepiece of a pair of eyeglasses may be inserted in order to pendulously support the eyeglasses. As shown in FIGS. 6 and 8, eyeglass holder 100 may be pinned to any garment using the same pin and clasp means as described above in reference to the preferred embodiment. However, as shown in FIGS. 5 and 7, eyeglass holder 100 may be provided with loop 160 which is integrally formed with first portion 110 and used as a means to suspend eyeglass holder 100 about the neck from a neck chain. Furthermore, eyeglass holder 100 is provided with third portion 140 which is integrally formed with first portion 110 and second portion 120 to define opening 150 (see FIG. 7).

Many employers require the display of identification badges by their employees in an easily noticeable place. If the employee does not have a shirt pocket to clip the badge to, then it cannot be easily displayed. However, eyeglass holder 100 solves that problem by being provided with third portion 140 which is used as a place from which to suspend an identification badge. Eyeglass holder 100 is merely pinned onto the garment from which the badge must be displayed or suspended from the neck using a chain placed through loop 160, and then the badge is clipped onto third portion 140.

While a specific preferred embodiment of the invention has been described, it will be recognized by those skilled in the art that variations may be made without departing from the spirit and scope of the invention, as described in the appended claims.

I claim:

1. An eyeglass holder adapted to be used with a pair of eyeglasses comprising:

a continuous loop of substantially rigid material bent to form a first portion and a second portion substantially perpendicular to said first portion wherein said first and second portions form an opening therebetween;

said first portion being provided with a pin and clasp means whereby said eyeglass holder can be pinned to any piece of clothing in any position; and said opening being formed such that a temple sidepiece of said pair of eye glasses may be hung over the periphery of the continuous loop on said second portion and supported in a pendulous position in a manner wherein said pair of eye glasses maintains a substantially downward orientation regardless of said eyeglass holder orientation.

2. The combination of claim 1 further including means comprising a third portion integrally formed with said first position and substantially perpendicular to said second portion.

3. The combination of claim 1 wherein said first portion is further provided with a loop so that said eyeglass holder may be suspended about the neck.

4. An eyeglass holder comprising:

a continuous loop of substantially rigid material bent to form a first portion and a second portion substantially perpendicular to said first portion wherein said first and second portions from an opening therebetween;

said first portion being provided with a pin and clasp means whereby said eyeglass holder can be pinned to any piece of clothing in any position;

said opening being formed such that a temple side piece of a pair of eyeglasses may be hung over the periphery of the continuous loop on said second portion and supported in a pendulous position in a manner wherein said pair of eyeglasses maintains a substantially downward orientation regardless of said eyeglass holder orientation; and said holder further including means comprising a third portion integral with said first portion for suspending articles therefrom and wherein said second portion is intermediate the first and third portions.

* * * * *